US005353940A

United States Patent [19]

Pech et al.

[11] Patent Number: 5,353,940

[45] Date of Patent: Oct. 11, 1994

[54] ALIGNMENT SYSTEM FOR CRANE WORKS AND METHOD OF ALIGNMENT

[75] Inventors: David J. Pech; Jeff J. Jeske, both of Manitowoc, Wis.

[73] Assignee: The Manitowoc Company, Inc., Manitowoc, Wis.

[21] Appl. No.: 1,835

[22] Filed: Jan. 8, 1993

[51] Int. Cl.[5] ..... B66C 23/26

[52] U.S. Cl. ..... 212/180; 175/189; 175/253

[58] Field of Search ..... 212/175, 176, 177, 178, 212/179, 180, 181, 253, 189

[56] References Cited

U.S. PATENT DOCUMENTS

| | | | |
|---|---|---|---|
| 1,436,608 | 11/1922 | Rodier . | |
| 2,136,255 | 11/1938 | Scanlon . | |
| 2,965,245 | 12/1960 | Zeilman et al. . | |
| 2,973,942 | 3/1961 | Schaper . | |
| 3,034,659 | 5/1962 | Willison et al. | 212/175 |
| 3,624,784 | 11/1971 | Larson et al. . | |
| 3,726,418 | 4/1973 | Short . | |
| 3,921,817 | 11/1975 | Petrik et al. . | |
| 3,923,407 | 12/1975 | Jensen et al. . | |
| 3,941,252 | 3/1976 | Six et al. . | |
| 4,000,784 | 1/1977 | Morrow, Sr. et al. . | |
| 4,014,400 | 3/1977 | Cline et al. . | |
| 4,195,740 | 4/1980 | Beduhn et al. . | |
| 4,248,488 | 2/1981 | Sable . | |
| 4,273,244 | 6/1981 | Jensen et al. . | |
| 4,436,444 | 3/1984 | Scherrer . | |
| 4,508,232 | 4/1985 | Lampson . | |
| 4,601,401 | 7/1986 | Wittman et al. . | |
| 4,632,261 | 12/1986 | Cuhel . | |
| 4,632,262 | 12/1986 | Olsen et al. . | |
| 4,640,421 | 2/1987 | Mason . | |
| 4,662,527 | 5/1987 | Cuhel . | |
| 4,700,851 | 10/1987 | Reeve et al. . | |
| 4,773,811 | 9/1988 | Wasner | 414/401 |
| 5,016,422 | 5/1991 | Popp et al. . | |
| 5,148,929 | 9/1992 | Wernecke et al. . | |
| 5,176,267 | 1/1993 | Pech . | |
| 5,189,605 | 2/1993 | Zuehlke et al. . | |
| 5,199,586 | 4/1993 | Pech et al. . | |

FOREIGN PATENT DOCUMENTS

| | | |
|---|---|---|
| 2841378A | 4/1980 | Fed. Rep. of Germany . |
| 397470 | 1/1974 | U.S.S.R. . |
| 979-254-A | 11/1982 | U.S.S.R. . |

OTHER PUBLICATIONS

American ® Crawler Cranes Series 1000" brochure.
Manitowoc 3900T Series-2 Specifications brochure.
Sumitomo LS-368RH5 Hydraulic Crawler Crane brochure.
Article "Solving the Quick-Disconnect Problem for Big Bearings" dated Jul. 7, 1983.
Link-Belt ®, "HC-268 Lattice Boom Truck Crane, Lift-Off System" undated.

*Primary Examiner*—Michael S. Huppert
*Assistant Examiner*—Thomas J. Brahan
*Attorney, Agent, or Firm*—Willian Brinks Hofer Gilson & Lione

[57] ABSTRACT

A system for aligning a crane upper works with a crane lower works for redecking the upper works with the lower works comprises at least one roller operatively connected to at least one of the upper works and the lower works, and at least one surface operatively connected to at least one of the upper works and the lower works. The at least one roller is engagable with the at least one surface such that the roller moves along the surface under the influence of gravity for aligning the upper works with the lower works. A method for aligning a crane upper works with a crane lower works for redecking the upper works with the lower works is also provided. The method comprises the steps of: providing an upper works having a roller operatively associated therewith; providing a lower works having an alignment surface operatively associated therewith; positioning the upper works with respect to the lower works such that the roller engages the alignment surface; and moving the roller along the alignment surface under the influence of gravity to align the upper works with the lower works.

28 Claims, 4 Drawing Sheets

ALIGNMENT SYSTEM FOR CRANE WORKS AND METHOD OF ALIGNMENT

BACKGROUND OF THE INVENTION

The present invention generally relates to a novel system and a novel method for aligning multiple parts of a larger piece of machinery for subsequent assembly into the larger piece, such as a piece of construction equipment. The invention more specifically relates to a novel system for and a novel method of aligning an upper works and a lower works of a piece of construction equipment, such as joining or redecking the upper works of a lift crane with its lower works.

Large pieces of machinery, such as cranes, excavators and other construction equipment, are often very expensive, sometimes costing on the order of hundreds of thousands of dollars. For many contractors, it is not economically feasible to own more than a few pieces of such machinery. Therefore, it is desirable to be able to transport this equipment from one job site to another in order to limit the number thereof which must be kept on hand in order to effectively compete in the construction business.

Because cranes and the like are often very large and heavy, possibly on the order of hundreds of tons, they can be quite difficult to transport. Certain weight restrictions on roads may prohibit contractors from moving their heavy equipment from one job site to another along the shortest or most convenient route. The contractors may be forced to take long, meandering paths during transport of the equipment. Because of the increased length of many of these paths, the travel time may be correspondingly increased, which can lead to lost revenues to the contractor due to the higher transportation costs, e.g. fuel, man power, and the like, and down time of the equipment during transport.

In an effort to facilitate this transport, construction equipment has been developed which comprises a plurality of smaller, lighter parts which can be repeatedly disassembled and reassembled. One example of such construction equipment is a self-assembling crane which generally comprises an upper works and a lower works that are releasable connectable. To transport this crane from one job site to another, the upper works is disassembled or undecked from the lower works. In some instances, undecking can be accomplished by a plurality of jacks which can raise the upper works off of the lower works. Once undecked, the upper works and the lower works can be loaded onto separate transport trailers and moved individually to the next job site. This may allow the contractor to use the shortest path between the two sites, thereby reducing transport and down time, to move the upper and lower works. Once the two works arrive at the next job site, they can be assembled or redecked to form the crane.

The methods of redecking can be rather complex. The upper works may be lifted by the jacks a sufficient distance to allow the lower works to be positioned underneath the upper works. Then, the upper and lower works must be aligned with respect to each other within acceptable tolerances for facilitating their assembly. This alignment can be difficult, especially upon consideration that both the upper works and the lower works may be quite heavy and burley, and that the tolerances may be rather small. Alignment may also be complicated by the possibly uneven terrain of the construction site. The alignment of the upper works with the lower works may become tedious, and considerable time and man power may have to be spent to properly align the works. The time and labor spent in aligning and subsequently redecking the upper works with the lower works may reduce the revenues saved by undecking the works in the first place.

One method of solving problems associated with the alignment of a crane upper works with a corresponding lower works is disclosed in U.S. Pat. No. 4,601,401. That patent discloses a redecking alignment system utilizing a number of interengagable centering pins and sockets. The upper works including the pins is placed upon the lower works which includes the sockets. The sockets are tapered, and a lubricous substance is provided adjacent the sockets to encourage the pins to slide into the sockets. As the centering pins slide into the sockets, the crane upper works moves into alignment with the lower works, thereby facilitating redecking. Once the pins are in the sockets, the pins must be removed to finish redecking the upper works with the lower works.

While this method may provide some advantages over other alignment systems and methods, this method possesses some drawbacks which may make it unattractive to some, and may render its performance suboptimal. Thus, a crane having this alignment system may not be desirable to some contractors.

For instance, this method requires the use of a float means under each of the jacks which raise and lower the upper works during alignment and redecking. The float means permits lateral shifting of the upper works relative to the lower works to facilitate full seating of the centering pins in the sockets as the upper works is lowered with respect to the lower works. This float means is expensive, creates an inherent instability in the structure during redecking, especially on uneven terrain, and adds additional elements which must be carefully monitored during alignment and redecking in order to insure proper alignment of the upper works with the lower works. Thus, the presence of the float means may further complicate the redecking procedure, and may increase the mount of time and labor required to transport and redeck the upper and the lower works. Once the works are aligned, the upper works must be raised in order to retract the centering pins, which adds yet a further step to the redecking procedure.

Another alignment system is disclosed in co-pending U.S. patent application Ser. No. 07/762,765, filed on Sep. 21, 1991. The disclosure of that application is incorporated herein in its entirety by reference. This system has many advantages, but is not constructed for use with truck mounted lift cranes, which have increased weight with respect to the lower works and asymmetrical axle placement. However, it is envisioned that this alignment system may be used with relatively small truck cranes.

As can be appreciated from the foregoing discussion, it is desirable to develop a novel apparatus and method for redecking an upper works with a lower works which is not subject to some, if not all of the limitations which effect the apparatuses and methods of the prior art. The present invention is intended to provide such a novel apparatus and method.

SUMMARY OF THE INVENTION

A general object of an embodiment of the present invention is to provide a novel system and a novel method of aligning a plurality of assemblies comprising a larger piece of equipment.

A more specific object of an embodiment of the invention is to provide a novel system and a novel method of aligning a crane upper works assembly and a crane lower works assembly during redecking.

Another object of an embodiment of the present invention is to provide a self-assembling crane having a novel alignment assembly.

A novel system, constructed according to the teachings of the present invention, for aligning a crane upper works with a crane lower works for redecking the upper works with the lower works comprises at least one roller operatively connected to at least one of the upper works and the lower works, and at least one surface operatively connected to at least one of the upper works and the lower works. The at least one roller is engagable with the at least one surface such that the roller moves along the surface under the influence of gravity for aligning the upper works with the lower works.

A novel method for aligning a crane upper works with a crane lower works for redecking the upper works with the lower works is also provided. The method comprises the steps of: providing an upper works having a roller operatively associated therewith; providing a lower works having an alignment surface operatively associated therewith; positioning the upper works with respect to the lower works such that the roller engages the alignment surface; and moving the roller along the alignment surface under the influence of gravity to align the upper works with the lower works.

In another aspect of the invention, a method for aligning a crane upper works with a crane lower works for redecking the upper works with the lower works comprises the steps of: providing an upper works having a longitudinal axis; providing a lower works having a longitudinal axis; gravitationally aligning the upper works with the lower works such that the longitudinal axis of the upper works is parallel to the longitudinal axis of the lower works; and translating the lower works with respect to the upper works to vertically align the upper works with the lower works.

BRIEF DESCRIPTION OF THE DRAWINGS

The organization and manner of the structure and operation of the invention, together with further advantages thereof, may best be understood by reference to the following description taken in connection with the accompanying drawings, wherein like reference numerals identify like elements in which.

DETAILED DESCRIPTION OF THE PREFERRED EMBODIMENTS

Figure 1:
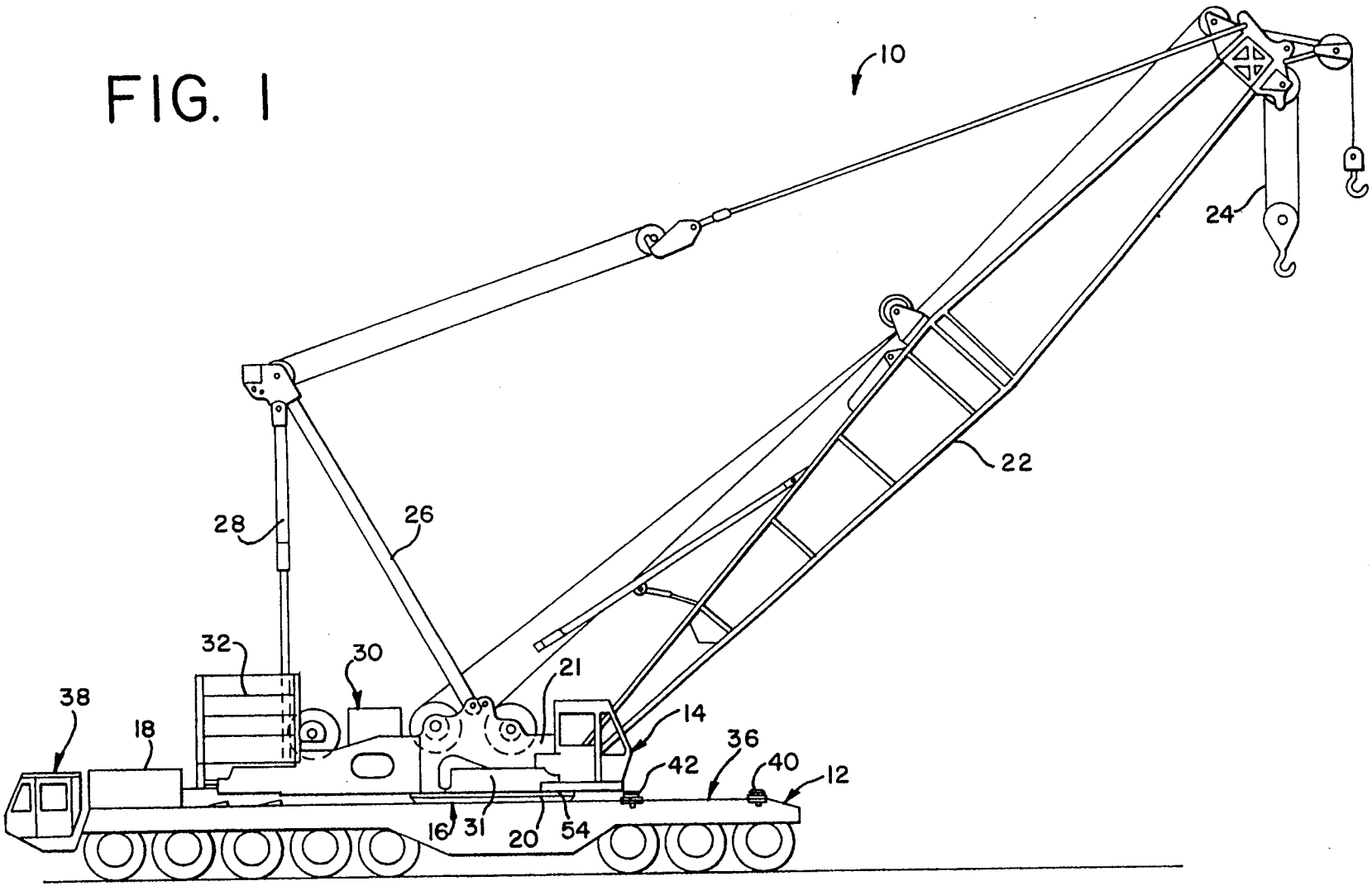
FIG. 1 is a side elevational view of a truck mounted crane having a novel alignment system constructed according to the teachings of the present invention.

While the invention may be susceptible to embodiment in different forms, there are shown in the drawings, and herein will be described in detail, specific embodiments with the understanding that the present disclosure is to be considered an exemplification of the principles of the invention, and is not intended to limit the invention to that as illustrated and described herein.

Referring initially to FIG. 1, there is shown a truck mounted self-assembling crane 10 possessing a currently preferred embodiment of a novel alignment system 12, constructed according to the teachings of the present invention. The alignment system 12 substantially aligns a first part or crane upper works 14 with a second part or crane lower works 16 of the crane 10, thereby facilitating redecking of the works 14 and 16. It is to be noted that, while the embodiments of the present invention will be discussed herein, for the sake of clarity, with respect to their employment with a truck mounted crane 10, the principles and teachings of the embodiments can be utilized with a number of different structures, such as other types of heavy machinery or construction equipment, for example, without departing from the scope of the invention. Hence, the embodiments of the invention are not limited to specific structural details of the crane 10. Thus, the construction of the crane 10 will be discussed in detail only to the degree necessary to provide one having ordinary skill in the art with sufficient background to practice the teachings of the invention.

Generally, the upper works 14 is releasably attachable to the lower works 16, which is, in turn, rotatably connectable to a truck crane carrier 18 by a swing bearing 20 so that when properly aligned with the swing axis of the upper works 14 in line with the swing axis of the lower works 16, the upper and lower works 14 and 16 are rotatable with respect to the truck crane carrier 18. The upper works 14 includes a rotating bed 21, a boom 22, rigging 24 extending from the boom 22, a gantry 26, a back hitch 28, and a power housing 30, which contains suitable prime movers, not shown, for energizing the crane 10. The lower works 16 includes an adapter frame 31. A counterweight 32 is also provided for balancing the crane 10. Because the upper works 14 and the lower works 16 are releasably attachable, they can be undecked and subsequently redecked to facilitate their transport from one work site to another on a transport trailer 34, shown in FIGS. 2 and 3, as discussed earlier.

Some additional elements of the crane 10 can be substantially similar to the like elements disclosed in the Wernecke U.S. Pat. No. 5,148,929, and the following co-pending U.S. patent applications: Ser. No. 07/926,812 filed Aug. 7, 1992; Ser. No. 07/833,772 filed Feb. 11, 1992; Ser. No. 07/762,767 filed Sep. 20, 1991; Ser. No. 07/762,766 filed Sep. 20, 1991; Ser. No. 07/762,765 filed Sep. 20, 1991; Ser. No. 07/736,029 filed Jul. 25, 1991; Ser. No. 07/566,751 filed Aug. 13, 1990; Ser. No. 07/556,840 filed Jul. 23, 1990; and Ser. No. 07/418,879 filed Oct. 10, 1989. That patent and those applications are assigned to the assignee of the present invention, and their disclosures are expressly incorporated herein in their entireties by these references. For instance, the rotating bed 21 and the adapter frame 31 may be identical to the like parts disclosed in Ser. No. 07/762,765 filed Sep. 20, 1991. However, other structures disclosed in that patent and those applications may not be suitable for use with the crane 10, such as the pendent alignment system also disclosed in the '765 application, because of the increased weight of and the asymmetrical placement of axles on the crane 10.

As shown in FIG. 1, the truck crane carrier 18 has a first end 36 and an opposite second end 38 with the swing bearing 20 attached to the crane carrier 18 at a position offset from a latitudinal midline of the crane carrier 18. A portion of the elements of the novel alignment system 12 are also visible in FIG. 1. Specifically, aligning elements or brackets 40 and 42 are disposed on a top side of the crane carrier 18 located between the swing bearing 20 and the first end 36. Because the alignment brackets 40 and 42 are connected to the crane carrier 18, and because the lower works 16 is also connected to the crane carrier 18 through the swing bearing 20, the alignment brackets 40 and 42 are operatively associated with the lower works 16. As will be discussed in greater detail below, the brackets 40 and 42 assist in aligning a longitudinal centerline of the upper works 14 with a longitudinal centerline of the lower works 16. By aligning the longitudinal centerlines, redecking of the upper works 14 with the lower works 16 can be facilitated.

Figure 2:
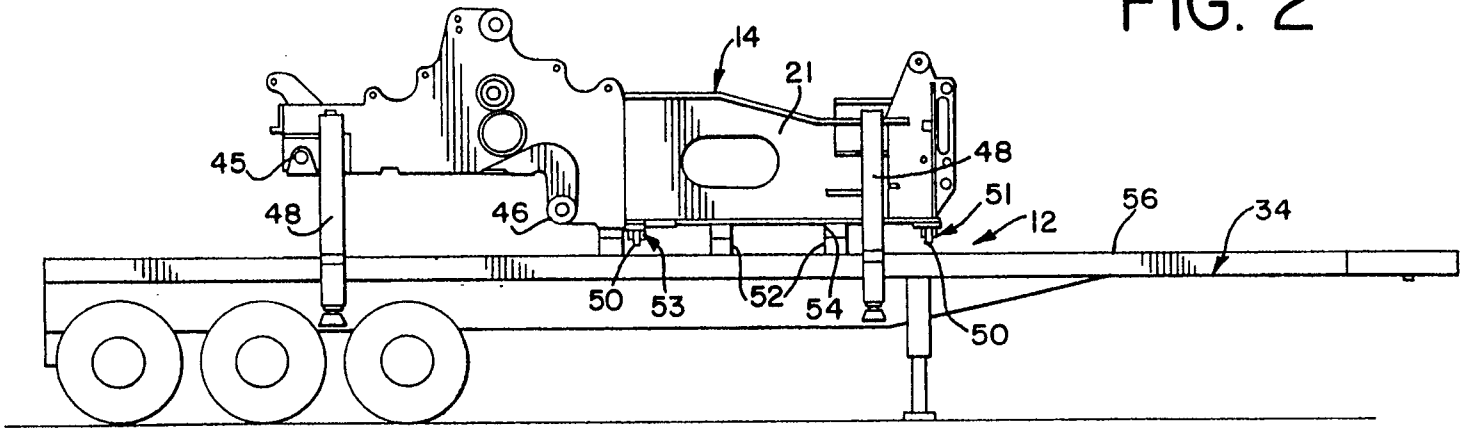
FIG. 2 is a side elevational view of an upper works of the crane of FIG. 1 disposed on a transport trailer.

The general construction of the rotating bed 21 of the upper works 14 is illustrated in FIG. 2. Once the upper works 14 has been undecked from the lower works 16, the rotating bed 21 can be loaded onto a transport trailer 34 for moving the rotating bed 21 and the remainder of the upper works 14 from one job site to another independently of the lower works 16. The rotating bed 21 includes a plurality of pin apertures 45 and 46 which; when aligned with corresponding apertures 45A, and 46A in the adapter frame 31 of the lower works 16, can accept pins for lockingly joining or securing the rotating bed 21 to the adapter frame 31 for redecking the upper and lower works 14 and 16, respectively. This will be discussed in greater detail later.

In order to further facilitate undecking and redecking, a plurality of jacks 48 are attached to the rotating bed 21 for vailably elevating the rotating bed 21, as can be appreciated by comparing FIGS. 2–5. In a currently preferred construction, there are four jacks 48, two disposed on opposite longitudinal sides of the rotating bed 21, and positioned adjacent opposite latitudinal sides thereof. The jacks 48 are positioned with respect to the rotating bed 21 so that the jacks 48 can supply sufficient stability to the rotating bed 21 when elevated and removed from the transport trailer 34. Accordingly, the jacks 48 are constructed to support at least the weight of the rotating bed 21, and to tolerate the stresses associated with undecking, aligning, and redecking the upper works 14 from the lower works 16. Also, the jacks 48 axe positioned such that they do not interfere with the transport trailer 34 or the truck crane carrier 18 when the rotating bed 21 is elevated above either the crane carrier 18 or the transport trailer 34. This allows the rotating bed 21 to be elevated above the transport trailer 34, the trailer 34 to be removed, and the truck crane carrier 18 to be positioned underneath the elevated rotating bed 21. The significance of this will become more clear later. The jacks 48 are preferably of a hydraulic type, being powered by a suitable prime mover, not shown, located in the power housing 30, and can be activated independently or conjointly. This allows the jacks 48 to level the rotating bed 21, even when located on uneven terrain. The jacks 48 may be substantially similar to the jacks disclosed in the above-referenced '765 application.

A portion of the novel alignment system 12 is also operatively associated with the rotating bed 21 and thus, the upper works 14. Specifically, a plurality of rotatable alignment elements or rollers 50 depend from an underside 54 of the rotating bed 21, as is visible in FIGS. 2 and 3. The rollers 50 are rotatably mounted on or journaled to the rotating bed 21 by shafts 49, shown in FIGS. 7 and 8. The rollers 50 are grouped into a first set 51 and a second set 53. The first set 51 of rollers 50 is positioned adjacent a latitudinal side of the rotating bed 21, and the second set 53 of rollers 50 is positioned proximate and substantially parallel to a latitudinal midline of the rotating bed 21. Thus, the first set 51 is offset from the second set 53 by a predetermined, longitudinal distance on the underside 54 of the rotating bed 21. In a currently preferred construction, three rollers 50 axe provided on the rotating bed 21. By using three rollers 50, three point support of the rotating bed 21 is provided, thereby insuring that each of the rollers 50 carries a load.

In order to reduce the probability of damage to the rollers 50 during transport of the rotating 21, the transport trailer 34 has a number of support blocks 52 on which the rotating bed 21 can rest. The support blocks 52 project from the flatbed 56 of the transport trailer 34 a distance greater than the distance between the underside 54 of the rotating bed 21 and terminal ends of the rollers 50. During transport, the underside 54 of the rotating bed 21 is placed upon the supporting blocks 52. The distance between the flatbed 56 and the terminal ends of the supporting blocks 52 is sufficient for providing clearance between the rollers 50 and the flatbed 56, as shown in FIG. 2.

Figure 7:
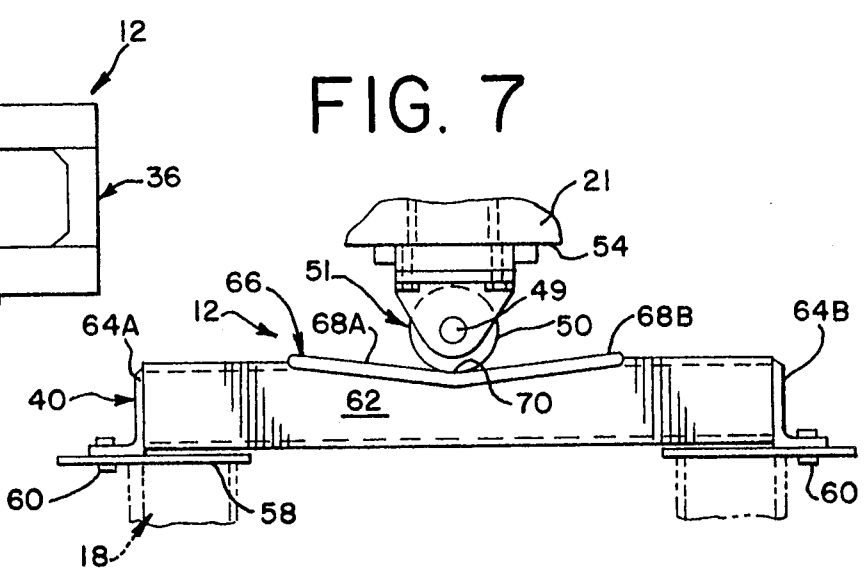
FIG. 7 is an enlarged elevational view of a first portion of the novel alignment system.
Figure 6:
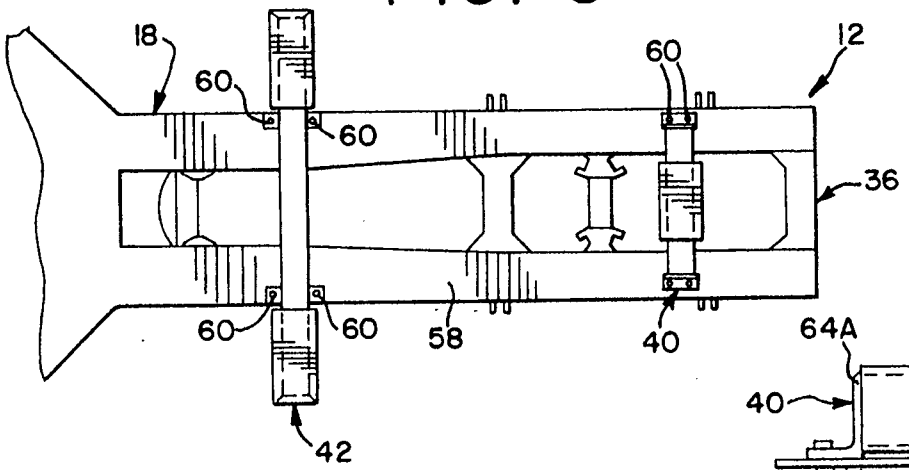
FIG. 6 is a top plan view of a portion of the truck crane carrier of FIG. 1 showing a portion of the novel alignment system of the invention.
Figure 8:
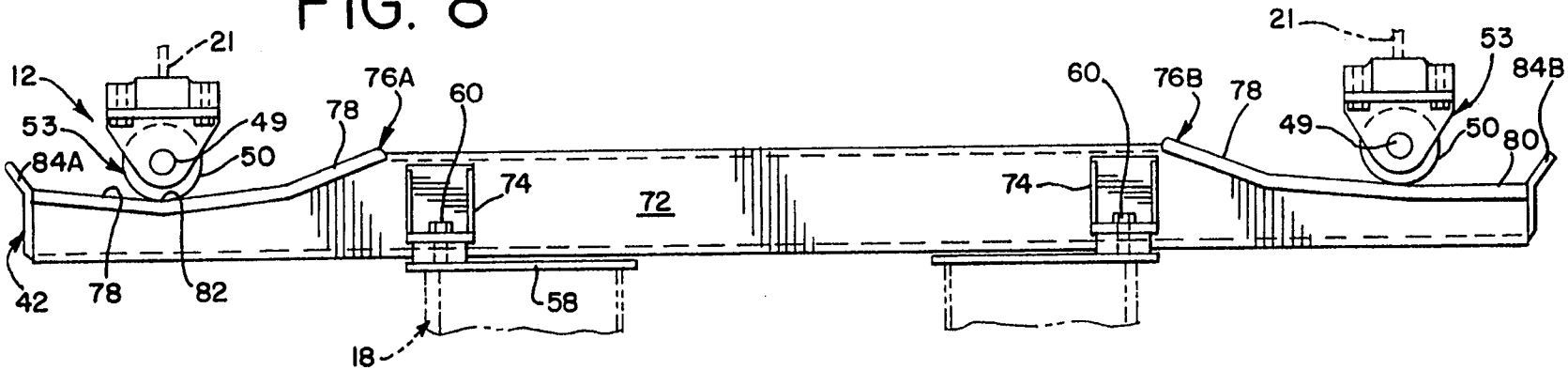
FIG. 8 is an enlarged elevational view of a second portion of the novel alignment system.

The novel structure and operation of the alignment system 12 may be greater appreciated with reference to FIGS. 6–8. FIG. 6 shows the construction and disposition of alignment brackets 40 and 42 adjacent the first end 36 of the truck crane carrier 18. The alignment brackets 40 and 42 are attached to a frame 58 comprising the truck crane carrier 18 by a plurality of bolts 60. The alignment brackets 40 and 42 are longitudinally offset on the frame 58 a distance equal to the predetermined, longitudinal distance between the first set 51 and the second set 53 of rollers 50. Therefore, appropriate positioning of the rotating bed 21 with respect to the adapter frame 31 can place the first set 51 of rollers 50 on the alignment bracket 40 and the second set 53 of rollers 50 on the alignment bracket 42. The location of the alignment brackets 40 and 42 on the frame 58 of the truck crane carrier 18 and the location of the first and second sets 51 and 53, respectively, of rollers 50 are predetermined such that, when the rollers 50 come to rest on the alignment brackets 40 and 42, the longitudinal centerlines of the rotating bed 21 and the adapter frame 31 are parallel, and in-line with each other.

The novel construction of the alignment bracket 40 is illustrated more clearly in FIG. 7. Specifically, the alignment bracket 40 comprises a bearing member 62 positioned and held between a plurality of mounting flanges 64A and 64B which are secured to the frame 58 by bolts 60. An alignment plate or surface 66 is disposed along the bearing member 62, and has a predetermined configuration for facilitating alignment of the rotating bed 21 with the adapter frame 31.

In the illustrated embodiment, the alignment surface 66 has a substantially concave configuration including substantially inclined portions 68A and 68B. With this configuration, if a roller 50, preferably of the first set 51 which includes only one roller 50 in the illustrated embodiment, engages the alignment surface 66 along either of the inclined portions 68A or 68B, the roller 50 will rotate about its shaft 49, and allow the gravitational force on the rotating bed 21 to move the roller 50 along the inclined portion 68A or 68B to the lowest point on the surface 66, which is a rest portion or margin 70 between the inclined portions 68A and 68B. When the roller 50 comes to rest at the margin 70, one end of the rotating bed 21 is centered on and aligned with the frame 58.

The novel construction of the alignment bracket 42 and the second set 53 of rollers 50 is illustrated in FIG. 8. The alignment bracket 42 includes a bearing member 72 attached to the frame 58 of the truck crane carrier 18 by a number of mounting flanges 74 which are, in turn, fixed to the frame 58 by bolts 60. Two alignment surfaces 76A and 76B are located on top of the beating member 72 and each includes a substantially inclined portion 78. Alignment surface 76B also includes a substantially flat portion 80. The inclined portion 78 of the alignment surface 76A is offset from the flat portion 80 by a distance corresponding to the lateral distance between the rollers 50 comprising the second set 53. Thus, appropriate positioning of the rotating bed 21 with respect to the adapter frame 31 places the rollers 50 of the second set 53 upon the alignment surfaces 76A and 76B. There is further provided, on at least one of the alignment surfaces 76A and 76B, a rest portion or margin 82 positioned between two adjacent and oppositely sloped inclined portions 78. The margin 82 functions substantially similarly to the margin 70, i.e. by providing a place along the alignment surfaces 76A and 76B whereat the rollers 50 can come to a rest.

When the rollers 50 of the second set 53 are placed upon the alignment surfaces 76A and 76B, the rollers 50 may be located upon an inclined portion 78. If this occurs, the rollers 50 rotate about their shafts 49 and move along the inclined portion 78 towards the flat portion 80. It is to be noted that only one of the rollers 50 comprising the second set 53 need be located upon an inclined portion 78 in order to cause movement of both of the rollers 50 conjointly from the inclined portion 78 to the flat portion 80. Because of this, a flat portion 80 and a margin 82 may be disposed entirely on one of the alignment surfaces 76A or 76B or may be disposed on both surfaces 76A and 76B, as illustrated in FIG. 8. By positioning one corer 50 on the flat portion 80 and a second roller 50 on the inclined portion 78, the movement of the second roller 50 along the inclined portion 78 can cause the first roller 50 to move along the flat portion 80 because movement of the rollers 50 is operatively coupled through the rotating bed 21. The second roller 50 comes to a rest once it reaches the margin 82. In order to limit movement of the rollers 50 on the alignment surfaces 76A and 76B, retaining members 84A and 84B are provided on opposite ends of the alignment surfaces 76A and 76B for insuring that the rollers 50 remain on the alignment surfaces 76A and 76B. In the illustrated embodiment, the positions of the rollers 50 of the second set 53 and the alignment surface 76A and 76B insure substantial horizontal or longitudinal alignment of the rotating bed 21 with the adapter frame 31 when the second roller 50 is at the margin 82. Thus, the conjunctive motion of the rollers 50 of the first and second sets 51 and 53 along the alignment surfaces 66 and 76A and 76B induces movement of the rotating bed 21 with respect to the adapter frame 31 for aligning the upper works 14 with the lower works 16 for redecking.

The embodiments of the present invention also provide novel methods for aligning parts of a larger piece of equipment, such as a crane 10. A greater appreciation for the structure and functionality of the embodiments of the invention may be gained with reference to the following discussion of the novel methods.

Drawing attention to FIG. 2, after undecking of the upper and lower works 14 and 16, respectively, the upper works 14 is transported to another work site by means of a transport trailer 34. The rotating bed 21 of the upper works 14 arrives at the work site disposed on a transport trailer 34 on top of support blocks 52 such that the underside 54 of the rotating bed 21 is offset above the flatbed 56 of the transport trailer 34. The rollers 50 are also offset above the flatbed 56 of the transport trailer 34. The jacks 48 depend from the rotating bed 21 downwardly beyond the flatbed 56 and are free to extend to the ground.

Figure 3:
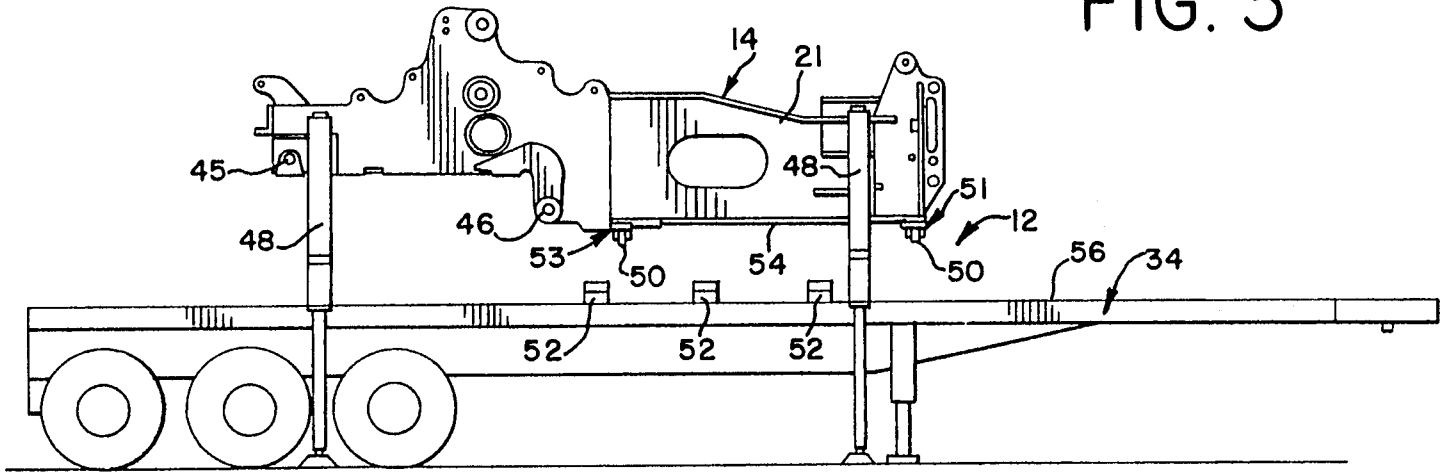
FIG. 3 is a view, similar to that of FIG. 2, illustrating the upper works elevated above the transport trailer by jacks.

As shown in FIG. 3, the jacks 48 are extended until they contact the ground, and continue to extend to elevate the rotating bed 21 off of the support blocks 52 of the transport trailer 34. The rotating bed 21 is elevated such that the clearance between the rollers 50 and the support blocks 52 is sufficient to allow for removal of the transport trailer 34 from underneath the elevated rotating bed 21. The transport trailer 34 is subsequently removed from underneath the rotating bed 21. During elevation of the rotating bed 21, the jacks 48 may be operated individually. This individual operation facilitates leveling of the rotating bed 21, which may be desirable, especially if the terrain of the work site is uneven. Once the rotating bed 21 is leveled, the jacks 48 may be operated conjointly, thereby preserving the level disposition of the rotating bed 21.

With the transport trailer 34 removed from underneath the elevated rotating bed 21, the truck crane carrier 18 can be moved underneath the rotating bed 21. The bed 21 is elevated so that there is sufficient clearance between the rotating bed 21 and the crane carrier 18 to facilitate this movement. The crane carrier 18 is positioned with respect to the elevated rotating bed 21 such that the rollers 50 of the first and second sets 51 and 53 are disposed generally vertically above the aligning brackets 40 and 42, respectively. It is to be noted that the aligning brackets 40 and 42 are of sufficient width so that precise positioning of the truck crane carder 18 underneath the rotating bed 21 is not required. The crane carrier 18 may also be leveled by adjusting the hydraulic suspension on the axles, if desired. The jacks 48 are again energized, and the jacks 48 lower the rotating bed 21 with respect to the crane carrier 18.

Figure 4:
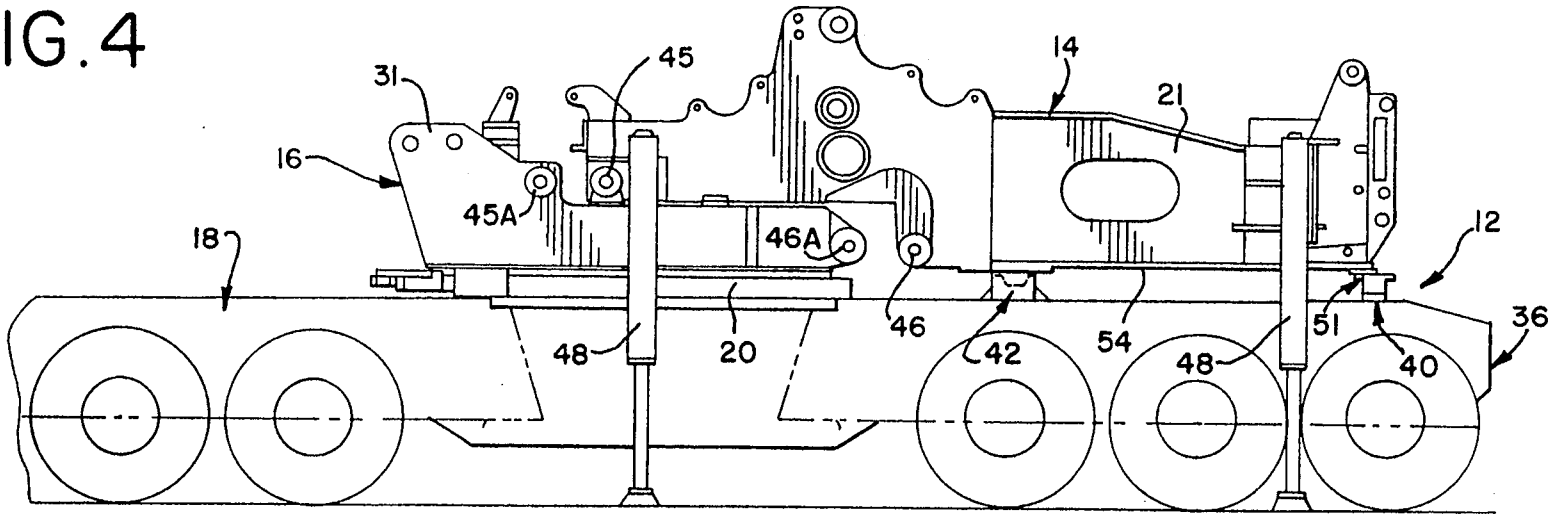
FIG. 4 is an enlarged partial side elevational view of the upper works of FIG. 3 positioned above and longitudinally aligned with a lower works disposed on a truck crane carrier.

The rotating bed 21 is lowered such that the first set 51 of rollers 50 engages the aligning bracket 40 and the second set 53 of rollers 50 engages the aligning bracket 42. As shown in FIG. 4, the rotating bed 21 is lowered sufficiently so that the rollers 50 rotatably contact the alignment surfaces 66 and 76A and 76B. As discussed above, the rollers 50 rotate about their shafts 49 so that the rollers 50 move along the inclined portions 68A, 68B, and 78 until the rollers 50 come to rest on the margins 70 and 82 and the flat portion 80. Because the jacks 48 are connected to the rotating bed 21, distal ends of the jacks 48 may be dragged along the surface of the work site terrain responsive to movement of the bed 21. The angles defined by the inclined portions 68A, 68B, and 78 are predetermined such that excessive side loading of the jacks 48 is substantially avoided as the rollers 50 contact and move along the inclined portions 68A, 68B, and 78. No float means, as is required with the structure disclosed in U.S. Pat. No. 4,601,401, is needed with the jacks 48 because the inclined portions 68A, 68B and 78 provide for transmission of horizontal loads to the truck crane carrier 18. Thus, the embodiments of the present invention represent a significant improvement over the structures and methods of the prior art.

As the rollers 50 move along the alignment surfaces 66 and 76A and 76B, the rotating bed 21 moves with respect to the adapter frame 31 until the longitudinal centerline of the bed 21 aligns with the longitudinal centerline of the frame 31. Because, in the illustrated embodiment, three rollers 50 are used to move the rotating bed 21 with respect to the adapter frame 31, a plane containing the longitudinal centerline of the rotating bed 21 is aligned in an initial alignment position with a plane which contains the longitudinal centerline of the adapter frame 31. The rotating bed 21 is longitudinally or horizontally aligned with the adapter frame 31 when the rollers 50 come to rest at the margins 70 and 82.

Figure 5:
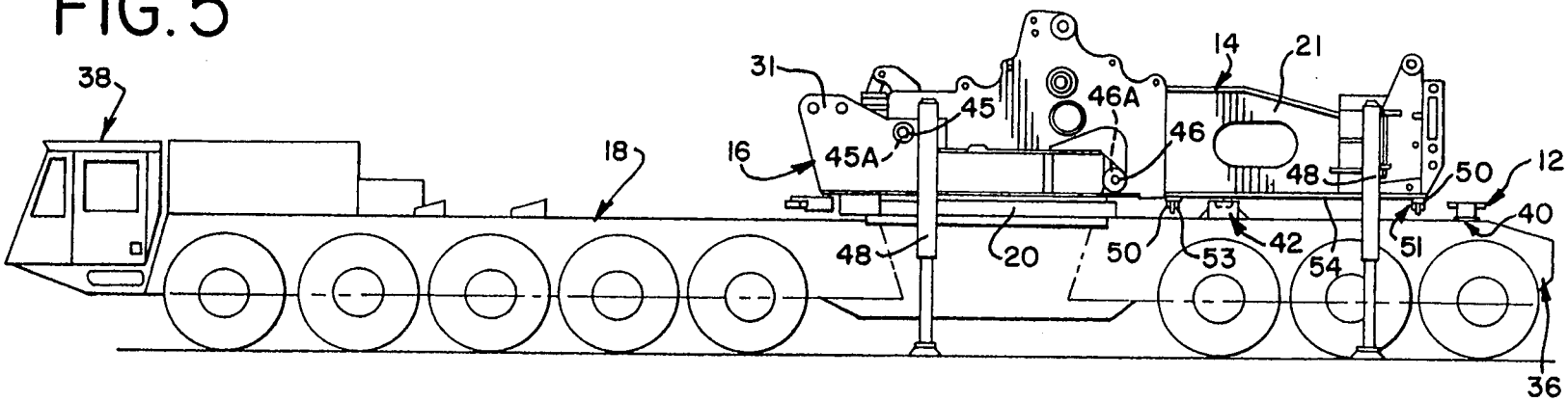
FIG. 5 is a side elevational view of the upper works of FIG. 4 vertically aligned with the lower works.

The jacks 48 are energized and the rotating bed 21 is elevated with respect to the adapter frame 31. Specifically, the bed 21 is elevated sufficiently to disengage the alignment brackets 40 and 42 and the rollers 50, and to provide clearance between the rollers 50 and the brackets 40 and 42 so that the truck crane carrier 18 is movable with respect to the elevated rotating bed 21. At this point, the crane carrier 18 is moved under the rotating bed 21, as shown in FIG. 5, to vertically align the pin apertures 45 and 46 on the rotating bed 21 with the pin apertures 45A and 46A on the adapter frame 31, which is its final alignment position where the swing axis of the upper works 14 is aligned with the swing axis of the lower works 16. The distance of this movement of the crane carrier 18 which is the distance the initial alignment position is offset from the final alignment position can be on the order of twelve inches. In this manner, vertical alignment of appropriate portions of the rotating bed 21 and the adapter frame 31 is insured. The jacks 48 are energized again, and the rotating bed 21 is lowered with respect to the adapter frame 31 so that the pin apertures 45, 45A, 46 and 46A align so that locking or securing pins can be inserted therethrough. Accordingly, this novel method allows for separation of horizontal and vertical alignments of the bed 21 and the frame 31. The rotating bed 21 is now attached to the adapter plate 31 and the truck crane carrier 18, and the redecking procedure can continue, as is well known, by attaching the remaining elements of the crane 10. As can be seen in FIG. 5, the rollers 51 and 53 are thus moved with respect to the alignment brackets 40 and 42 such that the rollers are not vertically over the alignment surfaces, thereby allowing for engagement of the upper works 14 to the lower works 16 and swing of the upper works 14 about its swing axis.

Given the foregoing discussion of the embodiments of the present invention, it can be appreciated that the embodiments provide a significant improvement in the art of aligning large, heavy pieces of self-assembling machinery, such as construction equipment and specifically truck mounted cranes. It is to be noted however that the scope of the invention is not to be limited to the above-discussed structures and methods. For instance, it is to be understood that the rollers 50 can be replaced with other movable elements or means for facilitating movement of the rotating bed 21 with respect to the adapter frame 31. In addition, in other embodiments of the invention, the rollers 50 can be disposed on the adapter frame 31, and the brackets 40 and 42 can be disposed on the rotating bed 21. Also, the brackets 40 and 42 may include any suitable combination of concave, inclined, sloped or flat surfaces. It is also envisioned that the brackets 40 and 42 may be adjustable in order to vary the angle of incline defined thereby. Additionally, a single roller 50 and a single bracket 40 or 42 may be provided on either the bed 21 or the frame 31, and additional alignment elements, such as those disclosed in all of the above-referenced patents and applications, may be added to the bed 21 or the frame 31 in combination with the roller 50. Furthermore, by separating longitudinal or horizontal and vertical alignments of the rotating bed 21 and the adapter frame 31, redecking can be facilitated because fewer elements or structures may be needed to align the upper works 14 with the lower works 16, and fewer steps may be required in the redecking procedure. This may result in revenue savings to the equipment owners and operators.

While preferred embodiments of the present invention are shown and described, it is envisioned that those skilled in the art may devise various modifications of the present invention without departing from the spirit and scope of the appended claims.

We claim:

1. A system for aligning a crane upper works having a swing axis with a crane lower works having a swing axis for redecking the upper works with the lower works, the system comprising:

a) at least one roller operatively connected to at least one of the upper works and the lower works;

b) at least one surface operatively connected to at least one of the upper works and the lower works; and c) the at least one roller being engagable with the at least one surface such that the at least one roller moves along the at least one surface under the influence of gravity for aligning the upper works in an initial alignment position which is offset from a final alignment position, said final alignment position having the swing axis of the upper works aligned with the swing axis of the lower works.

2. A system as defined in claim 1 wherein the at least one roller comprises a plurality of rollers operatively connected to the upper works.

3. A system as defined in claim 1 wherein the at least one surface comprises a plurality of surfaces operatively connected to the lower works.

4. A system as defined in claim 3 wherein at least one of the plurality of surfaces has a substantially concave configuration for facilitating alignment of the upper works with the lower works.

5. A system as defined in claim 3 wherein at least one of the plurality of surfaces has a substantially flat configuration for facilitating alignment of the upper works with the lower works.

6. A system as defined in claim 3 wherein at least one of the plurality of surfaces includes a substantially inclined plane.

7. A system as defined in claim 1 wherein the at least one surface has a substantially flat portion on which the at least one roller can rest, and a substantially inclined portion for gravity biasing the at least one roller towards the substantially flat portion.

8. A system as defined in claim 1 further comprising a jack for supporting the upper works during alignment of the upper works with the lower works.

9. A system as defined in claim 8 further comprising a plurality of jacks operatively connected to the upper works for variably elevating the upper works.

10. A system as defined in claim 9 wherein the jacks are operable independently and conjointly.

11. A method for aligning a crane upper works with a crane lower works for redecking the upper works with the lower works, the method comprising the steps of:

a) providing an upper works having a roller operatively associated therewith;

b) providing a lower works having an alignment surface operatively associated therewith;

c) positioning the upper works with respect to the lower works such that the roller is vertically over and engages the alignment surface;

d) moving the roller along the alignment surface under the influence of gravity to align the upper works with the lower works; and e) moving said roller with respect to said alignment surface such that the roller is not vertically over the alignment surface to thereby allow engagement of the upper works with the lower works and swing of the upper works.

12. A method as described in claim 11 wherein the positioning step c) further comprises:

i) elevating the upper works with respect to the lower works;

ii) placing the lower works beneath the upper works; and iii) lowering the upper works such that the roller engages the alignment surface.

13. A method as described in claim 12 wherein a jack operatively connected to the upper works elevates and lowers the upper works.

14. A method as described in claim 11 wherein a securing aperture is provided in the upper works and the lower works, and further comprising the steps of:

f) elevating the upper works with respect to the lower works after the upper works has been aligned with the lower works; and g) moving the lower works with respect to the upper works for vertically aligning the securing aperture in the upper works with the securing aperture in the lower works.

15. A method as described in claim 11 wherein the alignment surface on the lower works includes a substantially flat portion and a substantially sloped portion, and further comprising the steps of:

f) engaging the substantially sloped portion with the roller; and g) moving the roller along the substantially sloped portion under the influence of gravity towards the substantially flat portion for aligning the upper works with the lower works.

16. A method as described in claim 11 wherein a jack is operatively connected to the upper works and further comprising the step of:

f) substantially leveling the upper works with the jack.

17. A method as described in claim 11 wherein at least one of the upper works and the lower works comprises at least a second roller and at least one of the upper works and the lower works comprises at least a second alignment surface, wherein at least one of the alignment surfaces includes at least one rest portion whereat at least one of the rollers can come to a rest and at least one substantially inclined portion whereat at least one of the rollers is encouraged to move towards the at least one rest portion under the influence of gravity, and further comprising the steps of:

f) engaging at least one of the rollers with the at least one substantially inclined portion such that the at least one of the rollers is encouraged to move towards the at least one rest portion; and g) moving the at least one of the rollers towards the at least one rest portion for aligning the upper works with the lower works.

18. A system for aligning a first part of a crane with a second part of the crane to construct said crane, the system comprising:

a) a roller operatively associated with the first part of the crane;

b) a surface operatively associated with the second part of the crane;

c) the roller being interengagable with the surface;

d) the surface having a configuration for facilitating alignment of the first part with the second part when one of said parts rests on top of the other of said parts; and e) the configuration of the surface and roller being such that the gravitational weight of the part on top causes the roller to roll only laterally along the surface to align the first part of the crane with the second part of the crane.

19. A system as defined in claim 18 further comprising a plurality of rollers operatively associated with the first part.

20. A system as defined in claim 18 further comprising a plurality of surfaces operatively associated with the second part.

21. A system as defined in claim 20 wherein at least one of the plurality of surfaces has a configuration for facilitating alignment of the first part with the second part; and wherein the configuration is substantially concave.

22. A system as defined in claim 20 wherein at least one of the plurality of surfaces has a configuration for facilitating alignment of the first part with the second part; and wherein the configuration is substantially flat.

23. A system as defined in claim 20 wherein at least one of the plurality of surfaces defines a substantially inclined plane.

24. A system as defined in claim 18 wherein the surface has a configuration for facilitating alignment of the first part with the second part; wherein the configuration has a substantially flat horizontal portion which the roller can rest in its aligned position; and wherein the configuration has a substantially inclined portion for gravity biasing the roller towards the substantially flat portion.

25. A method for aligning a crane upper works with a crane lower works for redecking the upper works with the lower works, the method comprising the steps of:

a) providing an upper works having a longitudinal axis;

b) providing a lower works having a longitudinal axis;

c) gravitationally aligning the upper works with the lower works such that the longitudinal axis of the upper works is parallel to the longitudinal axis of the lower works; and d) thereafter translating the lower works with respect to the upper works to vertically align the upper works with the lower works.

26. A method as defined in claim 25 wherein the gravitationally aligning step c) comprises contacting at least one rotatable alignment element and at least one alignment surface.

27. A method for aligning a crane upper works having a longitudinal axis with a crane lower works having a longitudinal axis for redecking the upper works with the lower works, the method comprising the steps of:

a) elevating the upper works with respect to the lower works;

b) locating the lower works below the upper works;

c) lowering the upper works into operative contact with the lower works;

d) moving the upper works under the influence of gravity with respect to the lower works for horizontally aligning the longitudinal axis of the upper works with the longitudinal axis of the lower works;

e) elevating the upper works with respect to the lower works to interrupt operative contact therebetween;

f) moving the lower works with respect to the upper works along the aligned longitudinal axes of the upper works and the lower works for vertically aligning the upper works with the lower works;

g) lowering the upper works with respect to the lower works; and h) securing the upper works to the lower works.

28. A method according to claim 27 wherein the moving step d) comprises:

i) moving the upper works transversely with respect to the lower works.

* * * * *

UNITED STATES PATENT AND TRADEMARK OFFICE

CERTIFICATE OF CORRECTION

PATENT NO. : 5,353,940
DATED : October 11, 1994
INVENTOR(S) : David J. Pech et al.

It is certified that error appears in the above-indentified patent and that said Letters Patent is hereby corrected as shown below:

On the Title Page

In the first column under "References Cited U.S. PATENT DOCUMENTS" please add the following:

2,620,075 12/1952 Hoyle et al.

In column 1, line 65, delete "burley" and substitute --bulky--.

In column 2, line 43, delete "mount" and substitute --amount--.

In column 5, line 46, delete "vailably" and substitute --variably--.

In column 5, line 59, delete "axe" and substitute --are--.

In column 6, line 22, delete "axe" and substitute --are--.

UNITED STATES PATENT AND TRADEMARK OFFICE

CERTIFICATE OF CORRECTION

PATENT NO. : 5,353,940
DATED : October 11, 1994
INVENTOR(S) : David J. Pech et al.

It is certified that error appears in the above-indentified patent and that said Letters Patent is hereby corrected as shown below:

In column 7, line 24, delete "beating" and substitute --bearing--.

In column 7, line 54, delete "corer" and substitute --roller--.

In column 8, line 54, delete "carder" and substitute --carrier--.

In claim 24, line 4, after "portion" insert --on--.

Signed and Sealed this

Twenty-second Day of April, 1997

Bruce Lehman

*Attest:*

BRUCE LEHMAN

*Commissioner of Patents and Trademarks*

*Attesting Officer*